US006290147B1

(12) United States Patent
Bertrand et al.

(10) Patent No.: US 6,290,147 B1
(45) Date of Patent: Sep. 18, 2001

(54) PULLOUT FAUCET WAND BUTTON MECHANISM

(75) Inventors: John E. Bertrand, Avon; David J. Kruszewski, Parma, both of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/665,549

(22) Filed: Sep. 19, 2000

(51) Int. Cl.[7] ..... B05B 1/16
(52) U.S. Cl. ..... 239/444; 239/583
(58) Field of Search ..... 239/443, 444, 239/446, 447, 530, 583

(56) References Cited

U.S. PATENT DOCUMENTS

| | | | | |
|---|---|---|---|---|
| 3,341,132 | * | 9/1967 | Parkison | 239/443 |
| 3,876,151 | | 4/1975 | Katva | 239/437 |
| 4,165,837 | | 8/1979 | Rudzaitis | 239/394 |
| 4,703,893 | | 11/1987 | Gruber | 239/391 |
| 5,033,897 | | 7/1991 | Chen | 401/281 |
| 5,100,055 | | 3/1992 | Rokitenetz et al. | 239/11 |
| 5,145,114 | | 9/1992 | Monch | 239/126 |
| 5,383,604 | | 1/1995 | Boesch | 239/447 |
| 5,433,384 | | 7/1995 | Chan et al. | 239/449 |
| 5,467,927 | | 11/1995 | Lee | 239/383 |
| 5,476,225 | | 12/1995 | Chan | 239/449 |
| 5,707,011 | | 1/1998 | Bosio | 239/447 |
| 5,735,467 | | 4/1998 | Lee | 239/414 |
| 5,772,120 | | 6/1998 | Huber | 239/391 |
| 5,918,816 | | 7/1999 | Huber | 239/391 |
| 6,045,062 | | 4/2000 | Bosio | 239/443 |
| 6,145,757 | * | 11/2000 | Knapp | 239/443 |

* cited by examiner

*Primary Examiner*—Robert M. Fetsuga
(74) *Attorney, Agent, or Firm*—Cook, Alex, McFarron, Manzo, Cummings & Mehler, Ltd.

(57) ABSTRACT

A multiple discharge faucet spout includes a shell with a waterway and a valve body positioned within the shell. The valve body has a water passage which communicates with the waterway and there is a stream discharge and a spray discharge functionally communicating with the valve body water passage. A valve member is movable within the valve body to control water flow from the waterway to either the spray discharge or the stream discharge. A movable control member is attached to the valve member and effective upon inward movement thereof to cause the valve member to close communication between the waterway and the stream discharge and open communication between the waterway and the spray discharge. A spring normally urges the valve member to a position in which the faucet has a stream discharge. A release member, rotatable on the valve member and faucet shell is attached for concurrent rotation to the control member and is effective, upon turning movement thereof, to cause the release of the valve member from the spray position to return it to the stream position. A flexible membrane is positioned within the release member, in alignment with the control member, for operation thereof.

10 Claims, 4 Drawing Sheets

PULLOUT FAUCET WAND BUTTON MECHANISM

THE FIELD OF THE INVENTION

The present invention relates to a multiple discharge faucet spout, which may be a part of a pullout faucet wand. The spout has both a stream discharge and a spray discharge. There is a movable valve member within the head of the spout which controls water flow to one or the other of the stream or spray discharges. The valve member is moved by pushing against a membrane at the top of the spout to change the valve member from its default position of a stream discharge to a spray discharge position. Upon water shutoff, the valve member returns, by the influence of a coil spring, to the stream discharge position. The top of the faucet spout includes a release member which, upon rotation, is effective to permit the valve member to return from the spray position to the stream position.

In prior faucet spouts, particularly of the wand type, there have been flexible elements which are used as the trigger to change the type of faucet discharge. It was not always possible in the prior art designs to return to a stream discharge from a spray without shutting off the water. Further, cosmetically, such triggers did not always appear to be a smooth and integral part of the wand shell, and there were often gaps between the trigger and the shell. The present invention provides a smooth appearing, gap-free faucet spout wand, with a flexible trigger, and an easily movable release member to return the faucet spout from a spray discharge to a stream discharge, even while water flow continues through the spout.

SUMMARY OF THE INVENTION

The present invention relates to a multiple discharge faucet spout and more specifically to such a spout in which a release member is utilized to return the spout to a stream discharge while water continues to flow through the spout.

A primary purpose of the invention is to provide a faucet spout of the type described using an elastomeric membrane to receive a manually applied force to change from a stream discharge to a spray discharge, with the cap supporting the membrane being rotatable and functioning as a release member to return to a stream position.

Another purpose of the invention is to provide a simply constructed reliable and compact trigger mechanism for controlling the type of discharge from a multiple discharge faucet spout.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
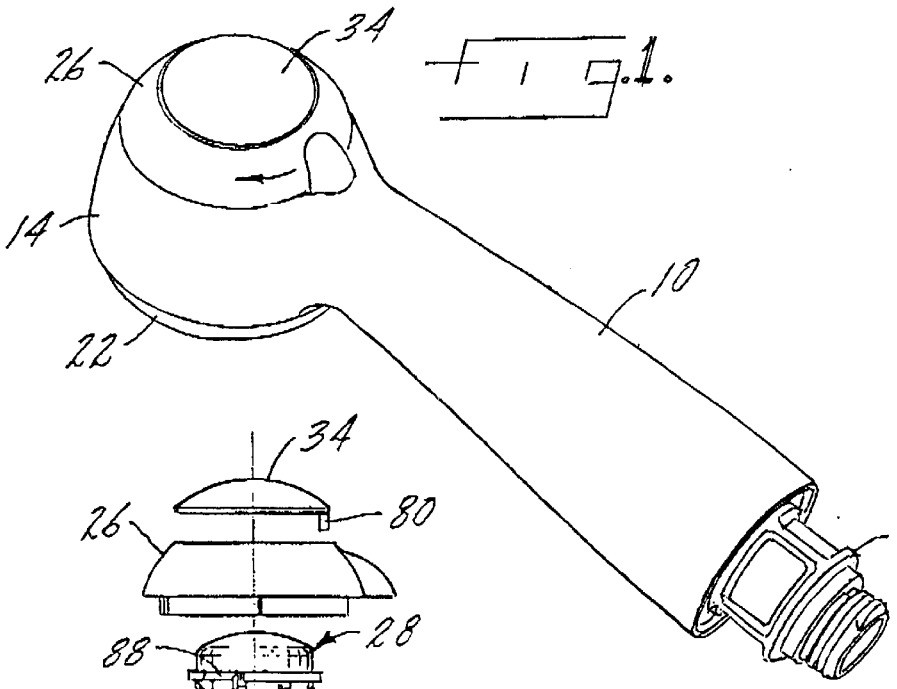
FIG. 1 is a top/side perspective of the faucet spout of the present invention.
Figure 2:
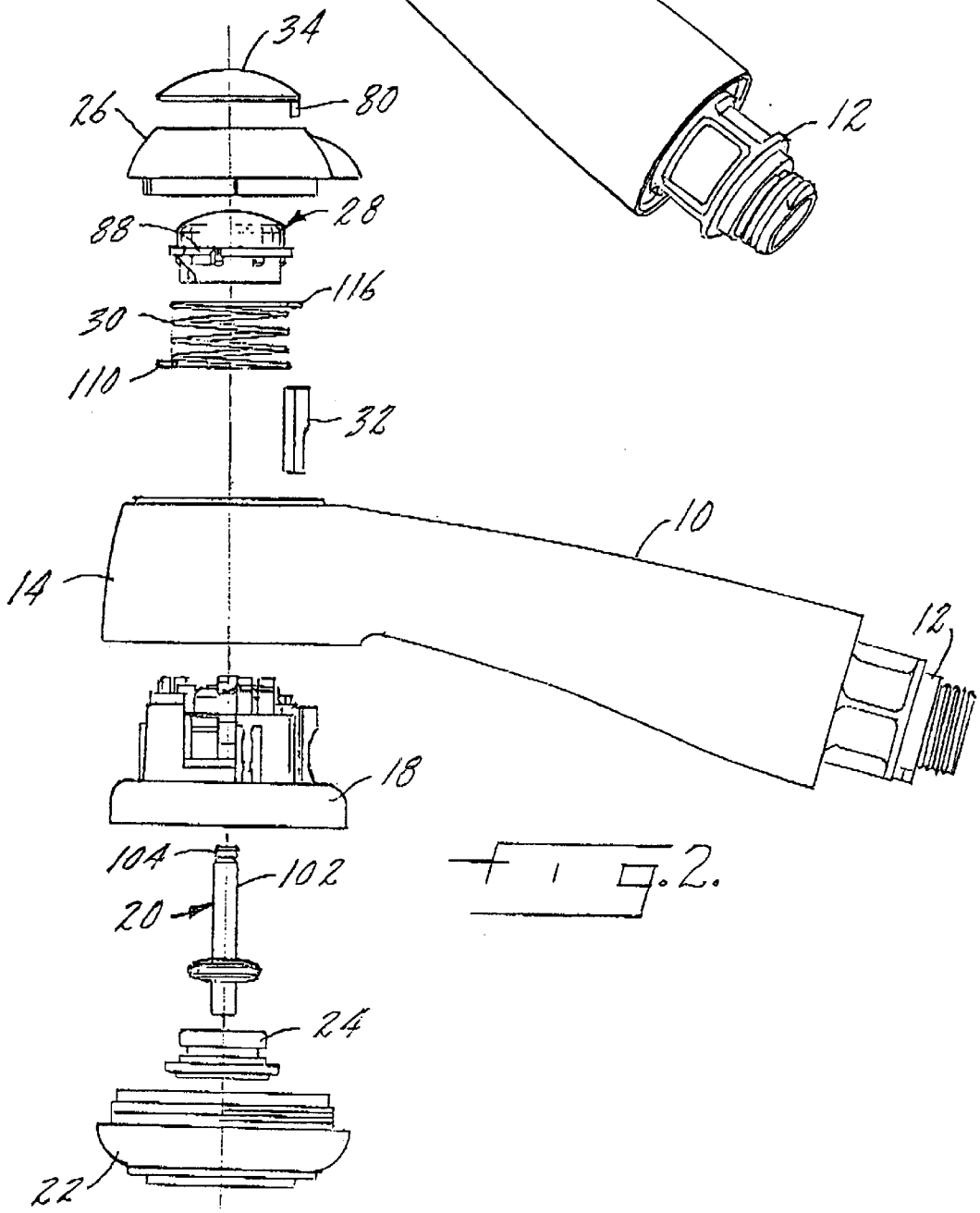
FIG. 2 is an exploded side view of the faucet spout.

The faucet spout as shown in FIGS. 1 and 2 includes a shell 10 having a connector 12 for use in attachment to a hose when the shell is a part of a pullout wand. The shell 10 has a head portion 14 within which is mounted the valve mechanism to control flow from the faucet spout. Within the shell 10 there is a waterway 16, shown in FIG. 3, which carries water into the valve mechanism. The components which comprise the valve mechanism for controlling flow include a valve member or cartridge 18, a valve stem or valve member 20, a spray head 22, and a valve seat 24. There is further a cap 26, a control member or button 28, a coil spring 30, a key 32, and a flexible membrane 34 which is attached to the cap 26.

The valve body 18 is attached to the shell 10 by means of snap features. The valve body has an arcuate slot 36 in alignment with an opening 38 which will receive the end 40 of the waterway 16. When the waterway is so positioned, the arcuate key 32 is inserted in the slot 36, the legs thereof extend on either side of the waterway and directly adjacent an outward flange 42 to thereby lock the waterway to the valve body 18.

The valve body 18 includes an internal water passage 44 which is in communication with the waterway 16 through an opening 46. The passage 44 contains the valve member 20 and has a pair of valve seats indicated at 48 and 50. The valve member 20 has a flange 52 mounting a seal ring 54, with the seal ring being arranged to close upon either of the seats 48 or 50 to direct water flow from the waterway to either the stream or spray discharge.

The seat member 24 is located within a sleeve portion 56 of the valve member and at its upper end defines the valve seat 50. A seal 58 is located within a groove in the seat member and bears against the inside wall of the sleeve portion 56.

The spray head 22 is threadedly attached to the valve member 18, as at 60, and has a circumferentially arranged array of spray discharge openings 62 which communicate with a spray head chamber 64, which is in turn in communication with the water passage 44 in the valve member 18. An aerator for a stream discharge is indicated at 66 and is mounted within the spray head 22 and directly in alignment with the seat member 24. The aerator 66 may include a screen 68, as is conventional, and a plurality of stream openings 70 to form the desired aerated stream discharge. The seat member 24 has an outwardly-extending flange 72 which rests upon an annular projection 74 in the spray head 22 to properly locate and align these elements.

Figure 3:
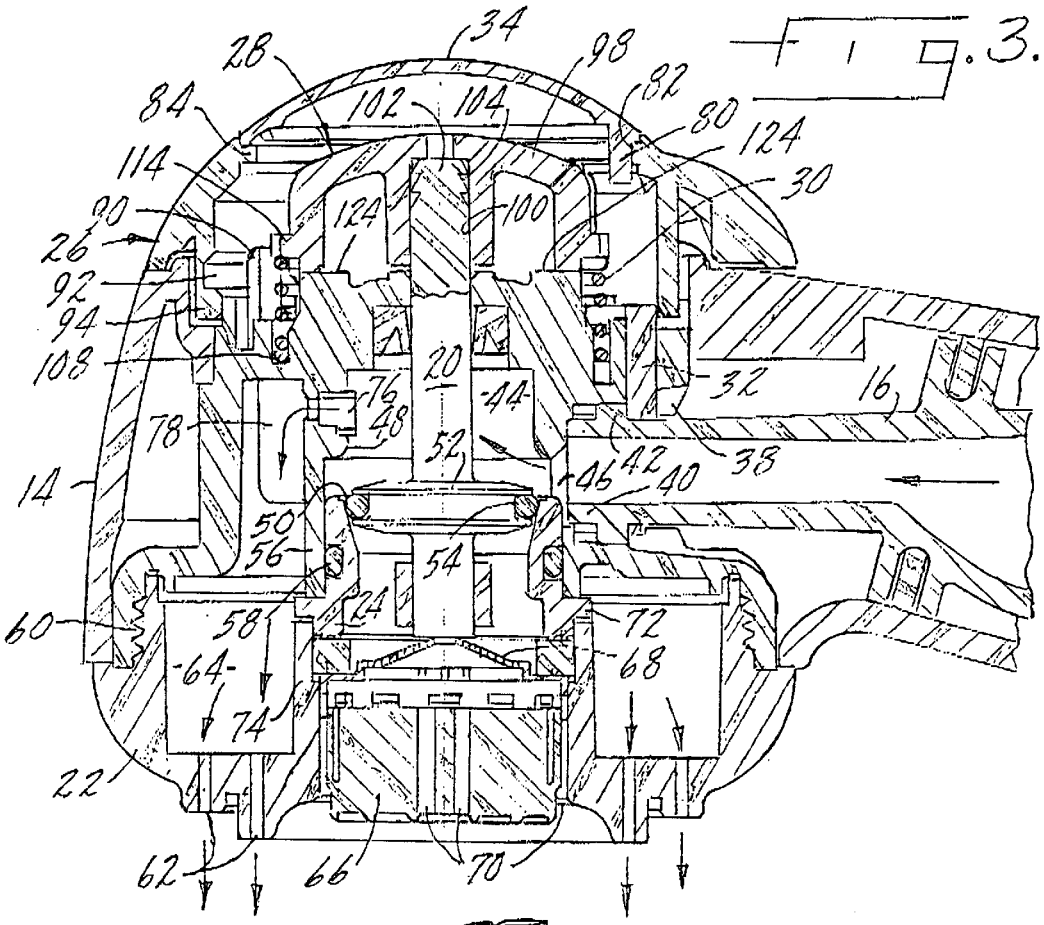
FIG. 3 is an axial section through the head of the faucet spout.

FIG. 3 illustrates the flow of water when the valve member 20 is in a spray position. The arrows shown in FIG. 3 trace the flow of water from the waterway into the valve member water passage 44, through a port 76 in the valve member, and downwardly through a chamber 78 to the spray head chamber 64 and then out through the spray openings 62. When the valve member 20 is in this position, water pressure upon the top of the flange 52 will hold the valve member in the spray position and the valve member will only be returned to the stream position in which its seal 54 is against seat 48 by turning off the water to release the pressure on the valve member, or through utilizing the release member to be described.

Figure 10:
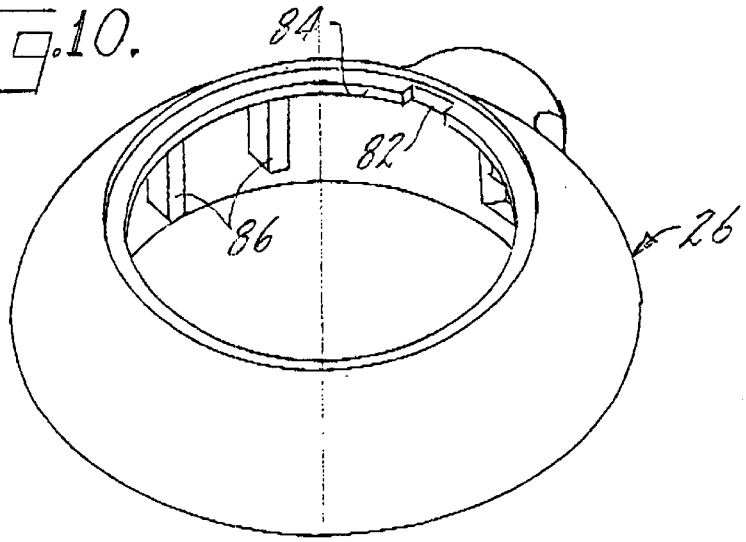
FIG. 10 is a perspective of the release member.

The cap 26 is somewhat conical in its outer configuration and mounts the flexible elastomeric membrane 34. The membrane 34 has a projection 80 which is seated within a groove 82 on the cap in order to properly locate the membrane within the cap. The membrane sits on a flange 84 as clearly shown in FIGS. 3 and 10.

Figure 7:
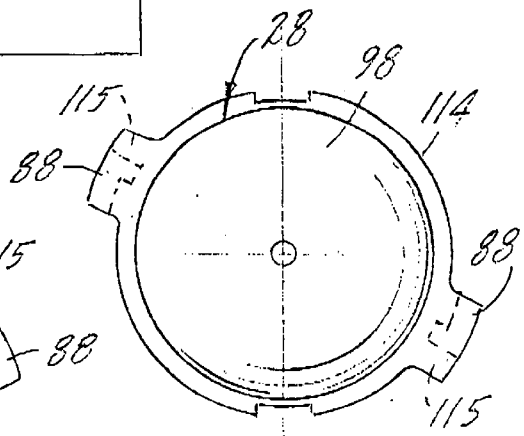
FIG. 7 is a top view of the control member.
Figure 9:
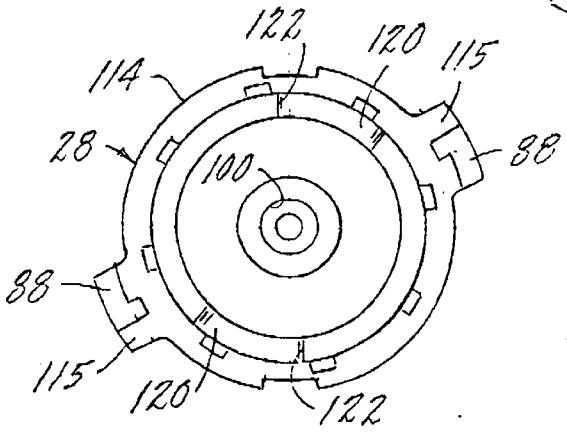
FIG. 9 is a bottom view of the control member.
Figure 8:
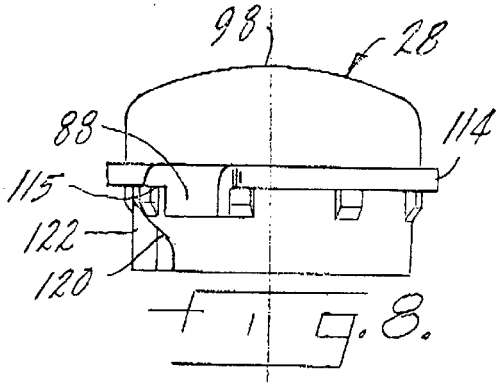
FIG. 8 is a side view of the control member.
Figure 11:
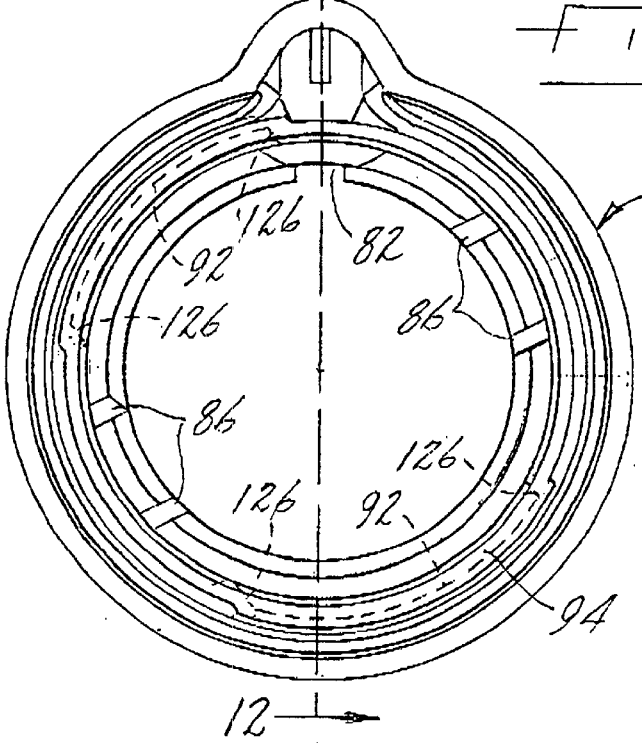
FIG. 11 is a bottom view of the release member.
Figure 12:
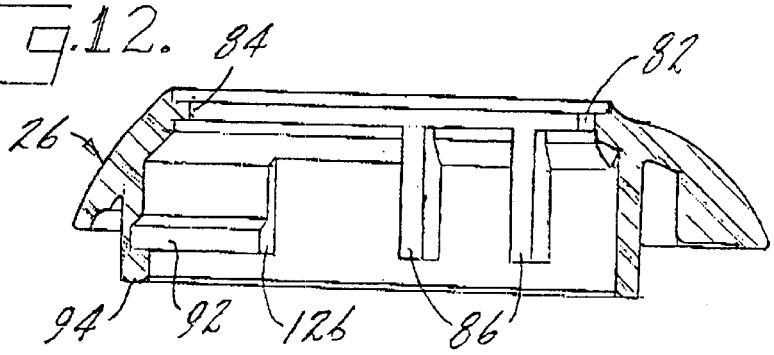
FIG. 12 is a section along plane 12—12 of FIG. 11.

As shown in FIG. 11, the interior of the cap 26 has diametrically opposed pairs of ribs 86, which ribs are used to connect the cap 26 and the control member 28 for concurrent rotation. The control member has a pair of outwardly-directed projections 88, illustrated particularly in FIG. 7, which projections are received between the ribs 86 so that rotation of the cap, which functions as a release member, concurrently rotates the button 28.

Figure 4:
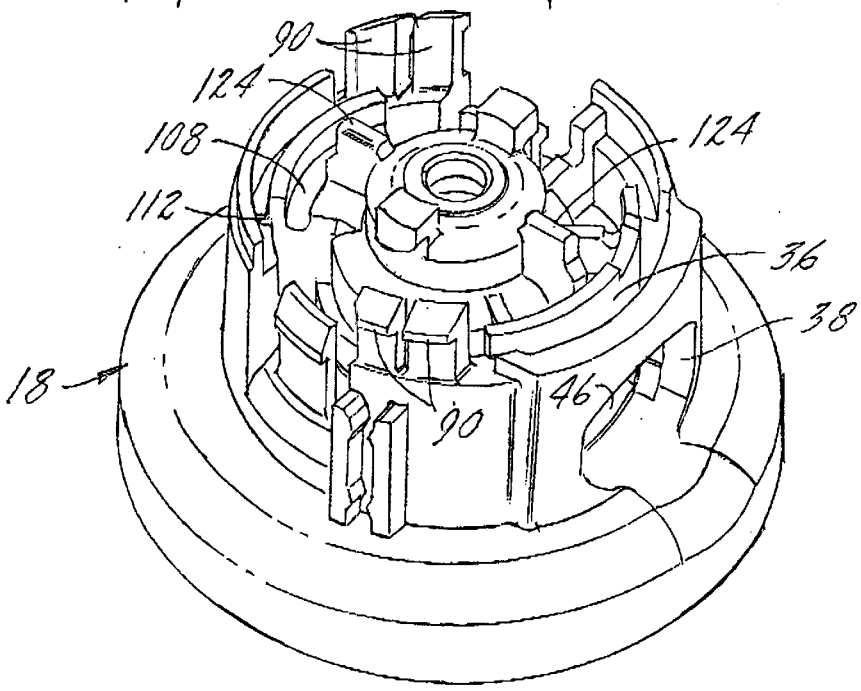
FIG. 4 is a top perspective of the faucet spout valve member.
Figure 5:
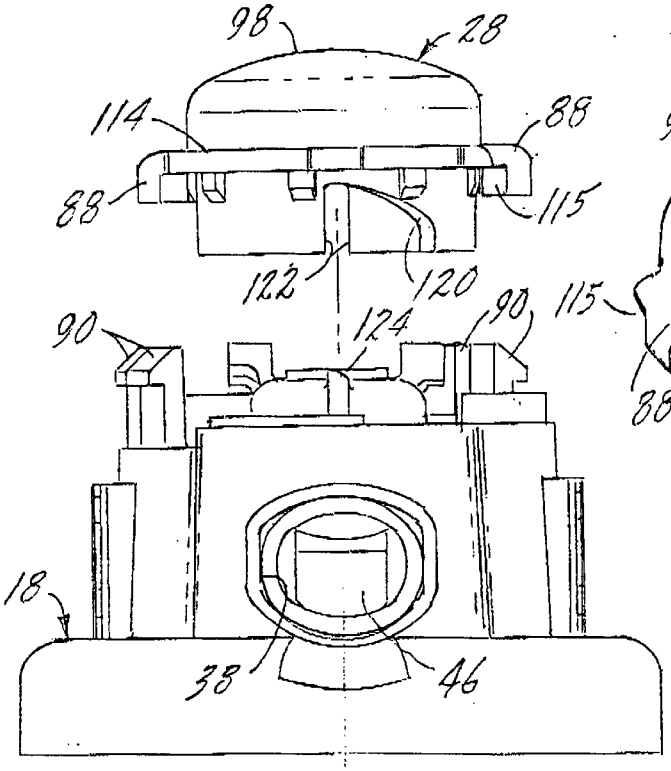
FIG. 5 is a side view showing the valve member and the control member in a spaced-apart relationship.
Figure 6:
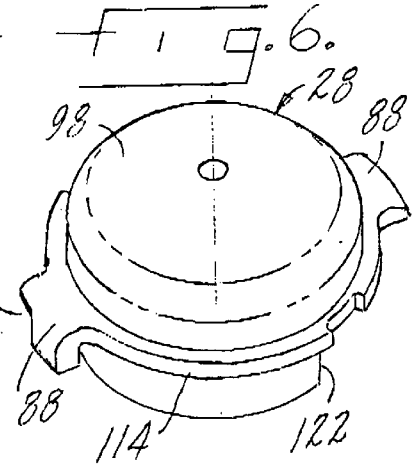
FIG. 6 is a top perspective of the control member.

The cap 26 is rotatably attached to the valve member by means of hook members 90, of which there may be four, as shown in FIGS. 4 and 5. The cap will be pressed downwardly upon the valve member until the hooks reside within grooves 92 formed in an arcuate flange 94 at the bottom of the cap 26. The attachment between the cap and the valve member provides for rotary movement of the cap relative to the valve member, as the cap functions as a release member to change the water discharge from spray to stream upon rotation thereof.

The control member 28 has an arcuate upper surface 98 which is in alignment with the elastomeric membrane 34 and so may be pushed downwardly by pressure applied to the membrane. The control member 28 has a bore 100 which receives the upper end 102 of the valve member 20. Barbs 104 assure a firm attachment of the upper portion of the valve member within the bore 100, thus firmly attaching the valve member to the control member. As an alternative, these members may have a snap attachment. A coil spring 30 is seated within an annular groove 108 in the upper portion of the valve body, with the inner end of the spring having a radially outwardly extending portion 110, which bears against a stop 112, allowing the spring to provide torsional return force to the cap 26.

The upper end of the spring 30 bears against a flange 114 on the control member and has an out-turned end 116 which bears against a notch 115 in one of the projections 88. The spring 30 provides both axial and radial force to the control member 28 and the cap 26.

The control member 28, as particularly shown in FIG. 5, has two diametrically opposed ramp surfaces 120 which each terminate in a vertical wall 122. These cam surfaces or ramps interact with a pair of diametrically opposed projections 124 on the upper end of the valve body 18.

When there is no water flowing through the faucet, the valve member 20 has its seal 54 against seat 48, as both the valve member and the control member 28 will be in an up position due to the force from spring 30. When water is initially turned on, it will flow downwardly through the aerator 68 after it passes through opening 46 and into the water passage 44. When the faucet user desires a spray discharge, pressure is applied to the membrane 34, which pushes the control member in an inward direction, moving it away from seat 48 and onto seat 50. The force applied is efficient to overcome the upwardly directed force from the spring 30. Once the valve member 20 has its seal 54 against seat 50, the down pressure on the upward side of flange 52 from the water flowing into the valve body will maintain the valve member in the spray position. Water will then flow in the direction of the arrows in FIG. 3 out through the spray openings 62.

If the water is turned off, spring 30 will urge the valve member 20 and the control member 28 to the default or return position in which the valve member seal 54 is against seat 48 or the stream position for the faucet.

However, if the user wishes to return to a stream discharge, without turning off the water, the user rotates the release member or cap 26 in a clockwise direction, as shown by the arrow in FIG. 1. Since the release member and the control member are joined for concurrent rotation through the described ribs and projections 86 and 88, such rotation will cause the projections 124 on the valve member to ride on the ramps 120 on the underside of the control member, which movement will force the control member in an outward direction, carrying the valve member 20 with it. This movement will be assisted by the force of the spring 30. Rotation of the cap or the release member 26 is limited by stops 126 in the grooves 92 of the end cap 26. As soon as the cap 26 is released by the faucet user, the torsion effect of the spring 30 will return the cap to the at-rest position shown in FIG. 1.

Of advantage in the invention is the simplified construction for providing the user both a stream and spray discharge and the ability to return to a stream discharge without shutting off the water. The flexible membrane provides a smoothly contoured exterior for the faucet spout or wand and is useful in transmitting discharge changing force to the control member or button 28 which lies beneath it.

Whereas the preferred form of the invention has been shown and described herein, it should be realized that there may be many modifications, substitutions and alterations thereto.

The embodiments of the invention in which an exclusive property or privilege is claimed are defined as follows:

1. A multiple discharge faucet spout including a shell having a waterway therein, a valve body positioned within the shell and having a water passage in communication with the waterway, water discharge means attached to the valve body and including a spray discharge and a stream discharge, a valve member movable within the valve body to control water flow from the valve body water passage to either the spray discharge or the stream discharge, spring means located on the valve body and normally biasing said valve member to a first position in which the valve member opens communication between the waterway and the stream discharge and closes communication between the waterway and the spray discharge, a movable control member attached to the valve member and effective, upon inward movement thereof, to move the valve member to a second position for closing communication between the waterway and the stream discharge, and opening communication between the waterway and the spray discharge, water pressure in said valve body water passage holding said valve member in said second position, a rotatable release member mounted on said shell and attached for concurrent rotation to said control member, interengaging release means on said control member and said valve body whereby rotary movement of said release member and control member effect outward movement of said control member to return said valve member to said first position.

2. The faucet spout of claim 1 wherein said control member is mounted on said valve body, with said spring means normally biasing said control member outwardly therefrom.

3. The faucet spout of claim 2 wherein said interengaging release means includes an outwardly-inclined ramp on said control member and a cooperating projection on said valve body, whereby rotary movement of said control member results in outward movement thereof.

4. The faucet spout of claim 3 wherein said interengaging release means includes a pair of diametrically opposed outwardly-inclined ramps on said control member and a pair of diametrically opposed cooperating projections on said valve body.

5. The faucet spout of claim 3 wherein said spring means imparts rotary force to said control member and release member to turn said control member and release member upon completion of the outward movement of said control member.

6. The faucet spout of claim 5 wherein said spring means is a coiled spring, attached at one end thereof to said valve body, and at another end to said control member, said spring being seated within a groove in said valve body.

7. The faucet spout of claim 1 wherein said valve body water passage includes spaced valve seats, said valve member having a sealing surface which closes on one or the other of said valve seats in said first and second positions of said valve member.

8. The faucet spout of claim 1 wherein said release member is attached for rotary movement to said valve body.

9. The faucet spout of claim 1 wherein said release member includes a flexible membrane attached thereto and in alignment with said control member.

10. The faucet spout of claim 1 wherein said water discharge means includes a spray head attached to said valve body and having a circumferential array of openings in communication with said valve body water passage, said discharge means further including an aerator positioned within said spray head and in communication with said valve body water passage.

* * * * *